US009119234B2

(12) United States Patent
Nobue et al.

(10) Patent No.: US 9,119,234 B2
(45) Date of Patent: Aug. 25, 2015

(54) DRAWER-TYPE HEATING APPARATUS

(75) Inventors: Tomotaka Nobue, Kyoto (JP); Yoshiharu Omori, Shiga (JP); Yuko Fujii, Shiga (JP)

(73) Assignee: PANASONIC INTELLECTUAL PROPERTY MANAGEMENT CO., LTD., Osaka-shi, Osaka (JP)

( * ) Notice: Subject to any disclaimer, the term of this patent is extended or adjusted under 35 U.S.C. 154(b) by 367 days.

(21) Appl. No.: 13/636,102

(22) PCT Filed: Mar. 23, 2011

(86) PCT No.: PCT/JP2011/001688

§ 371 (c)(1),
(2), (4) Date: Sep. 19, 2012

(87) PCT Pub. No.: WO2011/118204

PCT Pub. Date: Sep. 29, 2011

(65) Prior Publication Data

US 2013/0008894 A1 Jan. 10, 2013

(30) Foreign Application Priority Data

Mar. 23, 2010 (JP) ..... 2010-066065

(51) Int. Cl.
*H05B 6/64* (2006.01)
*H05B 6/66* (2006.01)
*H05B 6/76* (2006.01)

(52) U.S. Cl.
CPC ..... *H05B 6/6414* (2013.01); *H05B 6/76* (2013.01); *H05B 6/763* (2013.01)

(58) Field of Classification Search
CPC ..... H05B 6/6414; H05B 6/76; H05B 6/763
USPC ..... 219/678–680, 702, 736–743
See application file for complete search history.

(56) References Cited

U.S. PATENT DOCUMENTS 4,013,861 A 3/1977 Westfall
4,814,571 A * 3/1989 Bowen et al. ..... 219/757

(Continued)

FOREIGN PATENT DOCUMENTS

EP 0 598 580 A1 5/1994
EP 1 511 361 A2 3/2005

(Continued)

OTHER PUBLICATIONS

International Search Report for International Application No. PCT/JP2011/001688, dated Jun. 28, 2011, 2 pages.

(Continued)

*Primary Examiner* — Sang Y Paik
(74) *Attorney, Agent, or Firm* — Brinks Gilson & Lione

(57) ABSTRACT

A drawer type heating apparatus includes a heating case forming a heating space, and an openable door adapted to be moved in a drawing manner relative to the heating case for opening and closing an opening portion, and includes a radio-wave transmission suppression portion which is faced to inner wall surfaces of the opening portion of the heating case, and placed such that there is a predetermined gap between the radio-wave transmission suppression portion and the entire periphery of the inner wall surfaces of the opening portion in the heating case, in a state where the openable door is closed, the radio-wave transmission suppression portion including a first radio-wave-propagation-direction suppression-area constituted by a surface with a plurality of steps, and a second radio-wave-propagation-direction suppression-area having suppression protruding portions which are periodically formed and placed in such a way as to face the first radio-wave-propagation-direction suppression-area with a predetermined interval.

8 Claims, 6 Drawing Sheets

(56) References Cited

U.S. PATENT DOCUMENTS

| | | | | |
|---|---|---|---|---|
| 5,750,969 | A * | 5/1998 | Lee | 219/742 |
| 6,927,374 | B2 | 8/2005 | Hu et al. | |
| 2005/0056639 | A1 | 3/2005 | Hu et al. | |

FOREIGN PATENT DOCUMENTS

| | | | |
|---|---|---|---|
| EP | 2051564 | A1 * | 4/2009 |
| GB | 2 002 210 | A | 2/1979 |
| GB | 2076530 | A | 12/1981 |
| GB | 2 127 146 | A | 4/1984 |
| JP | 56-173907 | U | 12/1981 |
| JP | 58-028928 | A | 2/1983 |
| JP | 61-156690 | A | 7/1986 |
| JP | 1-257331 | A | 10/1989 |
| JP | 7-22833 | A | 1/1995 |
| JP | 2004-266438 | A | 9/2004 |
| JP | 2005-090942 | A | 4/2005 |
| JP | 2005-164091 | A | 6/2005 |
| JP | 2006-086004 | A | 3/2006 |
| JP | 2006-177639 | A | 7/2006 |
| JP | 2007-280786 | A | 10/2007 |
| JP | 2007-317605 | A | 12/2007 |
| JP | 2008-287904 | A | 11/2008 |
| JP | 2009-252346 | A | 10/2009 |

OTHER PUBLICATIONS

International Preliminary Report on Patentability for International Application No. PCT/JP2011/001688, dated Oct. 23, 2012, 7 pages.
Extended European Search Report in corresponding European Application No. 11759014.1, dated Jul. 10, 2015, 6 pages.

* cited by examiner

DRAWER-TYPE HEATING APPARATUS

This application a 371 application of PCT/JP2011/001688 having an international filing date of Mar. 23, 2011, which claims priority to JP2010-066065 filed Mar. 23, 2010, the entire contents of which are incorporated herein by reference.

TECHNICAL FIELD

The present invention relates to microwave heating apparatuses for heating objects to be heated within heating chambers, through microwave, and more particularly, relates to drawer type heating apparatuses which make it possible to take out objects to be heated within heating chambers to the outside of the heating chambers, by pulling out an openable door.

BACKGROUND ART

As conventional drawer type heating apparatuses, there have been suggested various heating apparatuses relating to pull-out mechanisms, placement of heating means, and the like (refer to Patent Literature 1, for example).

Ordinary microwave heating apparatuses employ hinge couplings, as mechanisms for opening and closing openable doors and such openable doors are of turning types. In microwave heating apparatuses having such turning-type openable doors, there have been suggested structures which provide, in an openable door, a rectangular plate-shaped choke portion (a radio-wave transmission suppression portion) facing the inner wall surfaces of a heating chamber, in order to suppress leakages of microwaves supplied to the heating chamber for housing objects to be heated, through the openable door (refer to Patent Literature 2, for example).

Further, there have been suggested methods of determining states of thawing of objects to be heated within a heating chamber, by detecting reflected electric power returning from the heating chamber while varying the frequency of microwaves supplied to the heating chamber (refer to Patent Literature 3, for example).

PLT 1: Unexamined Japanese Patent Publication No. 2005-164091

PLT 2: Unexamined Japanese Patent Publication No. 2005-090942

PLT 3: Unexamined Japanese Patent Publication No. 2006-086004

SUMMARY OF THE INVENTION

Technical Problem

In conventional drawer type heating apparatuses as disclosed in Patent Literature 1 as described, in order to suppress leakages of microwaves supplied to the inside of the heating chamber through the openable door, the mechanism for suppressing radio-wave transmission has been formed in a flange portion formed to protrude outwardly from the peripheral edge of the opening portion of the heating chamber and in the outer peripheral portion of the openable door which is faced to the flange portion. Accordingly, the openable door has been required to have a surface which faces the flange portion formed outwardly from the peripheral edge of the opening portion of the heating chamber and, therefore, the openable door has been structured to have a larger facing area, in comparison with the opening area of the heating chamber, in order to enclose microwaves within the heating space.

The conventional microwave heating apparatus disclosed in Patent Literature 2 is structured to be provided with the turning-type openable door using the hinge mechanism, wherein there is illustrated an example where a rectangular plate-shaped filter plate is orthogonally folded over its peripheral edge, and slits are formed in the folded area to form the choke portion, as a mechanism for suppressing radio-wave transmission. The choke portion is structured such that it is introduced within the heating chamber and is placed proximally to the wall surfaces of the heating chamber, when the turning-type openable door is closed. Accordingly, the openable door for forming the heating space within the heating chamber can be structured to have only a slightly larger area than the area of the opening portion of the heating chamber. Therefore, in the conventional microwave heating apparatus disclosed in Patent Literature 2, the openable door can be made to have a smaller size, in comparison with the opening portion of the heating chamber.

As described above, in the conventional microwave heating apparatus disclosed in Patent Literature 2, the turning-type openable door is provided with the choke portion with the slits having a length equal to the quarter-wavelength of radio waves, such that the choke portion is intruded in the heating chamber. Accordingly, it is necessarily necessary that the choke portion provided in the openable door is structured to have a thickness equal to or more than at least the quarter-wavelength of radio waves in the direction toward the heating chamber. In Patent Literature 2, the choke portion provided in the openable door is faced to the inner wall surfaces of the rectangular opening portion of the heating chamber, such that its four side portions are faced to the side portions of the heating chamber. Further, in the turning-type openable door adapted such that the choke portion having such a thickness is faced to the inner wall surfaces of the heating chamber, it is necessarily necessary that there is a larger gap between the choke portion and the heating chamber inner wall surface along the opening side along which the choke portion in the openable door comes to face the inner wall surface of the heating chamber opening portion, at last, in comparison with those along the other sides of the opening. Further, its four corner portions are faced to the corner portions of the heating chamber. At these corner portions, between the surfaces facing each other, there are gaps which are not the same as the gaps at the other portions. Namely, in the peripheral edge portions at which the heating chamber faces the choke portion of the openable door, the gaps between the corner portions facing each other are larger than the gaps between the straight portions facing each other.

Accordingly, the choke portion as the radio-wave transmission suppression mechanism has had the problem that it can not exert its radio-wave transmission suppression function at its corner portions. As described above, in such microwave heating apparatuses provided with turning-type openable doors, the inner wall surfaces of the opening portion of the heating chamber and the facing surfaces of the choke portion in the openable door are faced to each other, such that the interval between the inner wall surfaces and the facing surfaces is not constant over the entire outer peripheral portion, which has prevented reliable radio-wave transmission suppression effects from being expected.

The present invention is made in order to overcome the conventional problems described and aims at providing a drawer type heating apparatus which is provided with a radio-wave transmission suppression mechanism with excellent reliability between an openable door and inner wall surfaces of a heating chamber, thereby eliminating the necessity of structuring the openable door to be larger than the opening surface of the heating chamber and thus enabling compactification in the drawer type heating apparatus.

Solution to Problem

A drawer type heating apparatus in a first aspect of the present invention comprises a microwave radiation portion adapted to radiate microwaves within a heating space in which an object to be heated is placed; and a heating chamber structural member adapted to enclose microwaves radiated within the heating space; wherein the heating chamber structural member includes a heating case having an opening portion formed from a curved surface, and an openable door which is adapted to be moved in a pull-out manner with respect to the heating case for opening and closing the opening portion in the heating case and includes a radio-wave transmission suppression portion faced to an inner wall surface of the opening portion in the heating case, the radio-wave transmission suppression portion is placed such that there is a predetermined gap between the radio-wave transmission suppression portion and an entire periphery of the inner wall surface of the opening portion in the heating case, in a state where the openable door is closed, and the radio-wave transmission suppression portion includes a first radio-wave-propagation-direction suppression-area comprising a surface with a plurality of steps, and a second radio-wave-propagation-direction suppression-area comprising suppression protruding portions which are periodically formed and placed in such a way as to face the first radio-wave-propagation-direction suppression-area with a predetermined interval interposed.

In the drawer type heating apparatus having aforementioned structure in the first aspect of the present invention, the inner wall surface of the heating space at its opening portion is formed from a curved surface and thus has no corner portion. This can provide a substantially constant gap formed by the radio-wave transmission suppression portion and the inner wall surface of the opening portion, over the entire periphery. This enables the radio-wave transmission suppression portion provided in the drawer type openable door to certainly exert its function, over the entire periphery. This can provide a radio-wave transmission suppression mechanism with excellent reliability at the portion where the openable door faces the inner wall surface of the heating case. This can provide a drawer type heating apparatus including a compact openable door.

In a second aspect of the present invention, in the drawer type heating apparatus in the first aspect, the openable door includes a base plate having the first radio-wave-propagation-direction suppression-area having the plurality of steps formed through drawing processing, and a suppression plate having the second radio-wave-propagation-direction suppression-area in which the suppression protruding portions are periodically formed.

With the drawer type heating apparatus having the structure in the second aspect of the present invention, it is possible to create a space having an infinite impedance, between the first radio-wave-propagation-direction suppression-area in the base plate and the second radio-wave-propagation-direction suppression-area in the suppression plate, in order to enable the radio-wave transmission suppression portion to exert its function. By providing the first radio-wave-propagation-direction suppression-area in the base plate and the second radio-wave-propagation-direction suppression-area in the suppression plate and by making the gap between the areas have a space structure varied in a plurality of steps, the value of the characteristic impedance created by the first radio-wave-propagation-direction suppression-area in the root-side step in the suppression plate faced to the base plate having the plural-step structure is made larger than the value of the characteristic impedance created by the second radio-wave-propagation-direction suppression-area in the tip-end side step. As a result, due to an impedance transformation effect, it is possible to structure the radio-wave transmission suppression portion such that the space forming it has a length sufficiently shorter than the quarter-wavelength of transmitted waves. This enables the formation of the openable door to be compactified in the thick-wise direction. The openable door having such a structure can be formed such that its area which faces the inner wall surface of the opening portion of the heating case is compactified. Thus, the openable door can be made to have a structure which is light-weighted and compactified in its entirety.

In a third aspect of the present invention, in the drawer type heating apparatus in the second aspect, the openable door includes a supporting portion secured to a heating-space side of the openable door through the base plate and the suppression plate, and the supporting portion is adapted to hold a housing container on which the object to be heated is placed, and the heating case includes a guide portion which is secured to an inner wall surface of the heating case and is adapted to engage with a portion of the supporting portion to define an area within which the supporting portion is movable.

The drawer type heating apparatus having the structure in the third aspect of the present invention has a structure with excellent reliability, since the supporting portion is secured to the openable door secured to have a high strength. Further, the drawer type heating apparatus is adapted to enable the openable door to be largely pulled out, since the guide portion defines displacements of the supporting portion in the upward and downward direction.

In a fourth aspect of the present invention, in the drawer type heating apparatus in the aforementioned third aspect, the drawer type heating apparatus further comprises a microwave generating portion for supplying microwaves to an inside of the heating space, and a microwave radiation portion adapted to radiate microwaves from the microwave generating portion, within the heating space, wherein the microwave radiation portion is provided at a position on a wall surface of the heating case which is faced to a center of an area which specifies a housing position in the housing container within the heating space.

With the drawer type heating apparatus having the structure in the fourth aspect of the present invention, microwaves are directly incident to the object to be heated, which can increase the amount of losses in the object to be heated and thus, can reduce the amount of energy of microwaves propagating over the entire heating space, thereby suppressing unnecessary heat generation and unnecessary occurrences of sparks, in the housing container housed in the heating space, the supporting portion or the guide portion.

In a fifth aspect of the present invention, in the drawer type heating apparatus in the fourth aspect, the microwave generating portion includes an electric-power detection portion adapted to detect at least reflected microwave electric power, out of supplied microwave electric power supplied to the heating space, and reflected microwave electric power reflected from the heating space, and there is provided a control portion which is adapted to control an oscillating frequency of the microwave generating portion, based on a signal indicative of the reflected microwave electric power.

With the drawer type heating apparatus having the aforementioned structure in the fifth aspect of the present invention, at the beginning of start of heating, the frequency can be caused to sweep a specified range to determine an oscillating frequency which minimizes the reflected microwave electric power, this determined oscillating frequency can be selected as an operating frequency for heating, and the heating is continued, which enables electric power generated from the microwave generating portion to be supplied with highest efficiency. With the drawer type heating apparatus having the structure in the fifth aspect of the present invention, it is possible to utilize, as the microwave generating portion, one capable of generating smaller electric power, which can facilitate compactification of the entire heating apparatus.

In a sixth aspect of the present invention, in the drawer type heating apparatus in the fourth aspect, the drawer type heating apparatus further comprises a coaxial transmission line, as a transmission line for transmitting an output from the microwave generating portion to the microwave radiation portion.

With the drawer type heating apparatus having the structure in the sixth aspect of the present invention, it is possible to reduce the amount of microwave electric power reflected to the microwave generating portion, by utilizing the amount of transmission loss in the coaxial transmission line. This can suppress heat generation from the microwave generating portion, thereby ensuring reliable performance. With this structure, it is possible to eliminate an isolator as a component for taking countermeasures against reflected electric power, as those which have been generally employed.

In a seventh aspect of the present invention, in the drawer type heating apparatus in the fourth aspect, the microwave radiation portion comprises a patch antenna.

With the drawer type heating apparatus having the structure in the seventh aspect of the present invention, it is possible to place the antenna extremely close to the inner wall surface of the heating space, which enables providing a larger free space within the heating space.

In an eighth aspect of the present invention, in the drawer type heating apparatus in the fourth aspect, the microwave radiation portion comprises an antenna adapted to perform circularly-polarized wave radiation.

With the drawer type heating apparatus having the structure in the eighth aspect of the present invention, it is possible to supply two outputs from the microwave generating portion to a single antenna while providing a phase difference of 90 degrees therebetween, thereby realizing circularly-polarized wave radiation in the heating space. Therefore, the space occupied by the antenna within the heating space can be a substantially equal space to that of a patch antenna structure, and circularly-polarized waves can be directly incident to the object to be heated, which can facilitate heating of the object to be heated, and also, can further reduce the amount of energy of microwaves propagating within the heating space.

Advantageous Effects of the Invention

According to the present invention, it is possible to provide a drawer type heating apparatus having a compact structure which is capable of certainly preventing leakages of radio waves through an openable door and is capable of eliminating the necessity of forming the openable door to be larger than the opening surface of a heating chamber.

DETAILED DESCRIPTION OF THE PREFERRED EMBODIMENTS

Hereinafter, with reference to the accompanying drawings, there will be described preferred embodiments of a drawer type heating apparatus according to the present invention. Note that, in the following embodiments, drawer type heating apparatuses will be described with respect to examples where drawer type microwave heating apparatuses are structured solely such that they include an openable door movable in the horizontal direction for opening and closing a heating space. However, the drawer type heating apparatus according to the present invention is not limited to the structures of the microwave heating apparatuses which will be described in the embodiments and can be also applied to structures of microwave heating apparatuses which are mounted in drawer portions in system kitchens in cooking rooms or integrally incorporated in other apparatuses such as refrigerators and vending machines. Further, the present invention is not limited to concrete structures according to the following embodiments and includes heating apparatuses structured based on equivalent technical concepts.

First Embodiment

Figure 1:
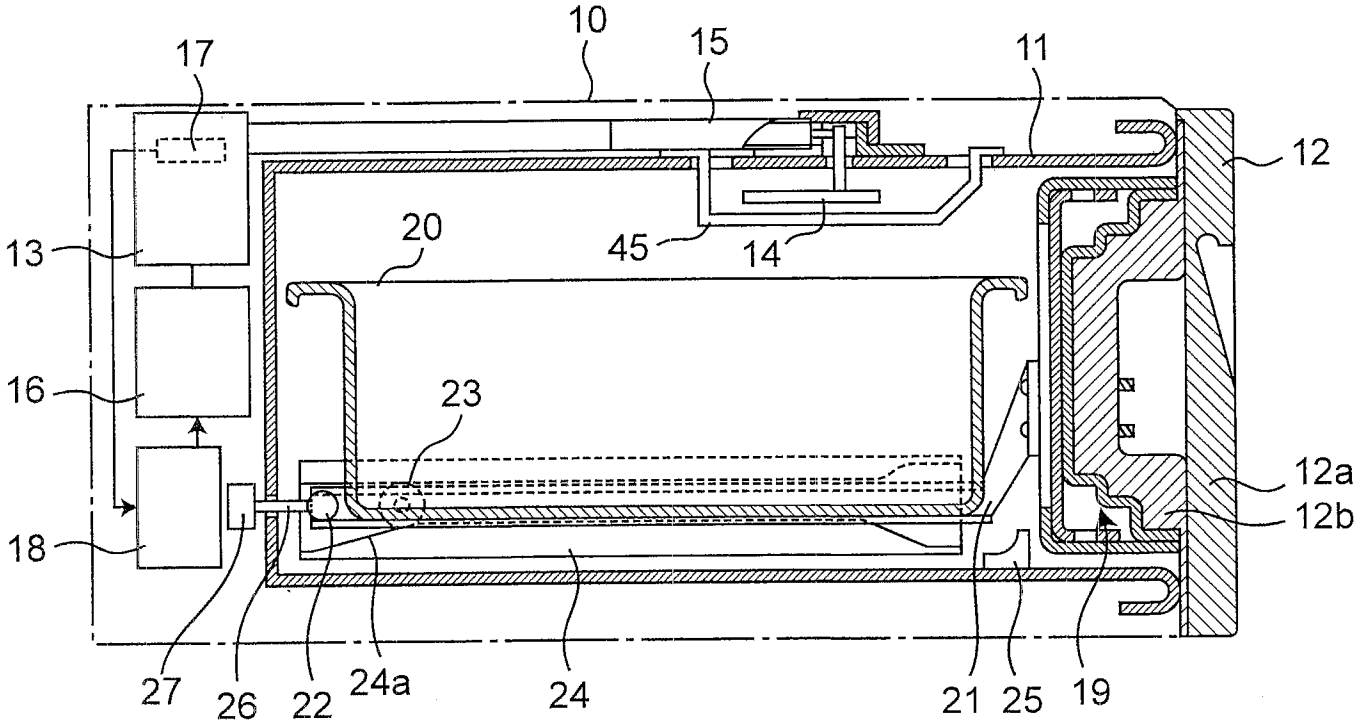
FIG. 1 is a cross-sectional view illustrating the structure of a drawer type heating apparatus according to a first embodiment of the present invention.
Figure 2:
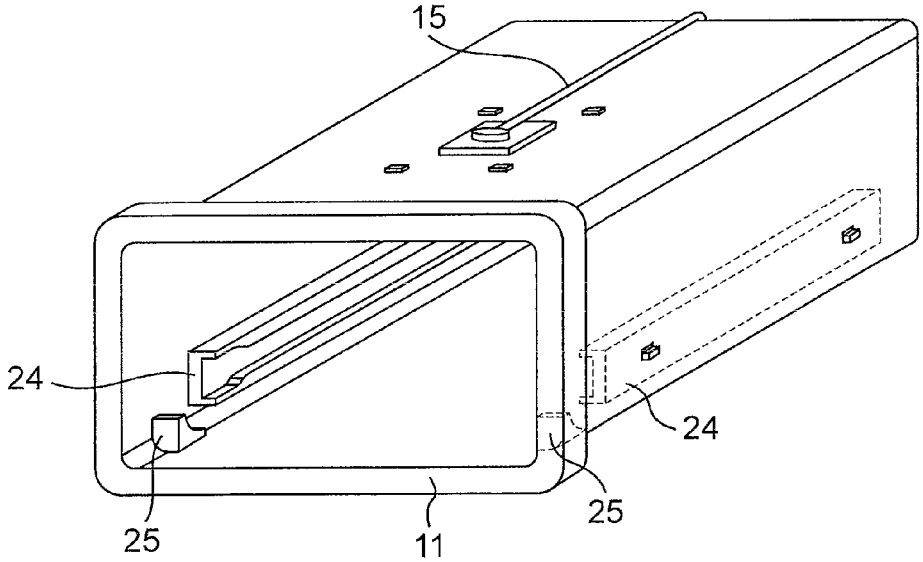
FIG. 2 is a perspective view illustrating a heating case which forms a heating space in the drawer type heating apparatus according to the first embodiment.
Figure 3:
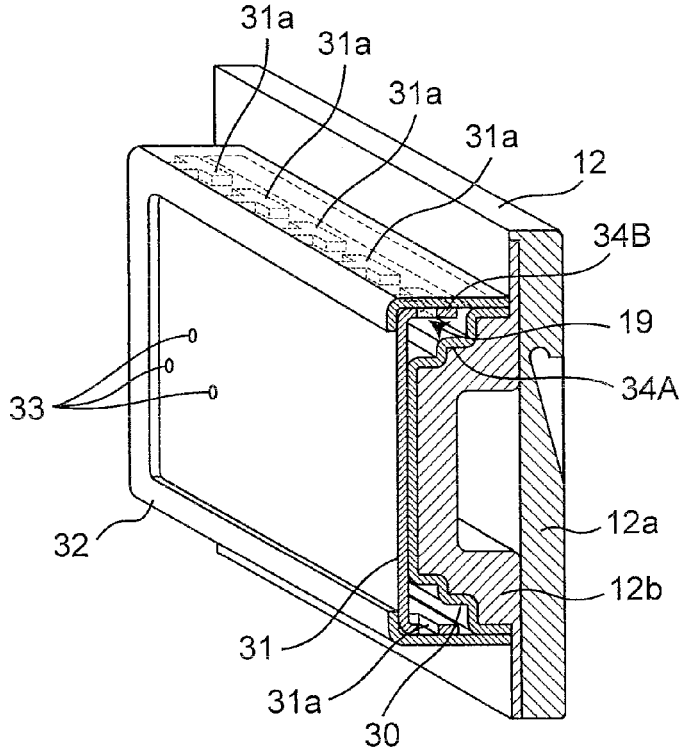
FIG. 3 is a perspective view illustrating a cross section of an openable door in the drawer type heating apparatus according to the first embodiment.
Figure 4:
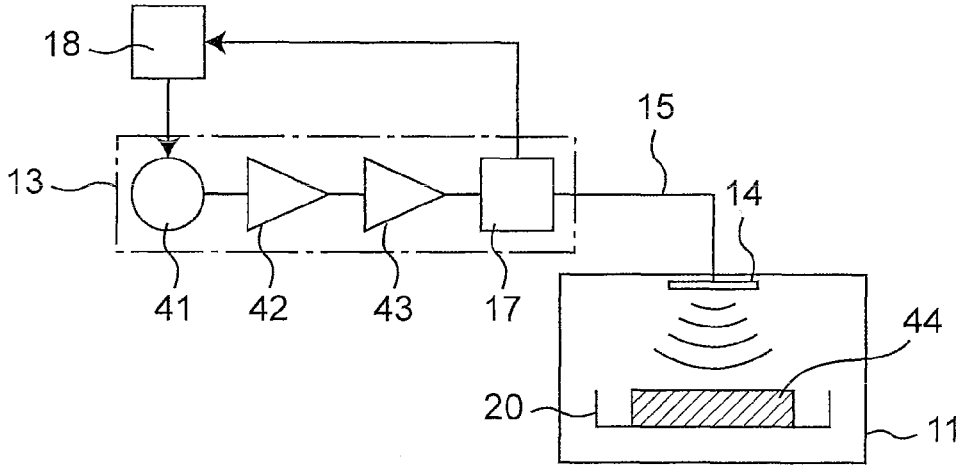
FIG. 4 is a block diagram illustrating the structure of a microwave generating portion in the drawer type heating apparatus according to the first embodiment.

FIG. 1 is a cross-sectional view illustrating the internal structure of a drawer type microwave heating apparatus as a drawer type heating apparatus according to a first embodiment of the present invention. FIG. 2 is a perspective view illustrating a heating case which forms a heating space in the drawer type heating apparatus according to the first embodiment. FIG. 3 is a perspective view illustrating a cross section of an openable door in the drawer type heating apparatus according to the first embodiment. FIG. 4 is a block diagram illustrating the structure of a microwave generating portion in the drawer type heating apparatus according to the first embodiment.

The drawer type heating apparatus 10 according to the first embodiment illustrated in FIGS. 1 to 4 is a microwave heating apparatus for thawing which is formed to be of a drawer type. Accordingly, the drawer type heating apparatus 10 according to the first embodiment has such specifications that its maximum output is smaller and is, for example, less than 500 W.

The drawer type heating apparatus 10 according to the first embodiment has the heating space formed by the heating case 11 and the openable door 12 and, further, is adapted to enclose, within the heating space, microwaves radiated within the heating chamber. Namely, in the structure according to the first embodiment, the heating case 11 and the openable door 12 form a heating chamber structural member. The heating case 11 forms the inner wall surfaces of the main body in the drawer type heating apparatus 10 and is made of a metal material. The openable door 12 is adapted to be movable in the horizontal direction with respect to the heating case 11 to make it possible to take out an object to be heated which is housed within the heating space, and has the function of opening and closing the heating space.

Further, the drawer type heating apparatus 10 according to the first embodiment is provided with a microwave generating portion 13 for generating microwaves, a microwave radiation portion 14 as an antenna for radiating microwaves within the heating space, a coaxial transmission line 15 for transmitting microwaves generated from the microwave generating portion 13 to the microwave radiation portion 14, a driving power supply 16 for the microwave generating portion 13, an electric-power detection portion 17 provided in an output side in the microwave generating portion 13, and a control portion 18 adapted to control operations of the microwave generating portion 13 and the driving power supply 16 for the microwave generating portion 13.

The Structure of the Openable Door

The openable door 12 is provided with a radio-wave transmission suppression portion 19. The radio-wave transmission suppression portion 19 is provided in the openable door 12, in its area which faces the inner wall surfaces of the opening portion of the heating case 11. The inner wall surfaces of the opening portion of the heating case 11, with which the radio-wave suppression portion 19 is internally in contact, are formed to have curved surfaces, at their four corner portions. On the other hand, the radio-wave transmission suppression portion 19 provided in the openable door 12 is also formed to have curved surfaces at its portions which face the four corner portions of the opening portion of the heating case 11, and thus the radio-wave transmission suppression portion 19 is structured to face the inner wall surfaces of the opening portion of the heating case 11 with a constant interval. As described above, the radio-wave transmission suppression portion 19 is formed in the openable door 12 in its heating-space side, such that there is a constant interval between the entire periphery of the radio-wave transmission suppression portion 19 and the inner wall surfaces of the opening portion of the heating case 11.

Further, a supporting portion 21 made of a metal material is secured to the openable door 12 in its heating-space side. The supporting portion 21 supports a housing container 20 on and in which an object to be heated is housed and placed, at the bottom surface thereof. The supporting portion 21 has a frame shape having two supporting members secured to the openable door 12 at left and right positions on the heating-space side. The supporting members in the left and right sides are coupled to each other through a coupling bar 22 near the rear surface of the heating space (in the left side of the heating space in FIG. 1). The coupling bar 22 forms a member for restricting the position of the housing container 20 within the heating space, since the coupling bar 22 comes in contact with the housing container 20 at its rear-surface portion.

Further, referring to FIG. 1, there is illustrated only one of the supporting members in the supporting portion 21 (the supporting member in the right side). The supporting members in the supporting portion 21 are coupled and secured, at their one ends, to the openable door 12, through screw assembling. Further, in this screw assembling, the radio-wave transmission suppression portion 19 having a structure which will be described later is concurrently secured to the openable door 12.

The openable door 12 is structured to include a door portion 12*a* provided with a handle, and a door body portion 12*b* formed integrally with the door portion 12*a*. The door portion 12*a* and the door body portion 12*b* are made of a resin material. The radio-wave transmission suppression portion 19 and the supporting portion 21 are concurrently secured to the door body portion 12*b*, through the screw assembling (see FIG. 1).

The supporting members in the opposite sides in the supporting portion 21 are coupled to each other, at their other ends (their rear-surface-side end portions), through the coupling portion 22 made of a resin material, with a predetermined interval. A roller 23 for smoothly moving the openable door 12 is rotatably mounted to the supporting members, in front of the position to which the coupling portion 22 is secured.

On the left and right wall surfaces of the heating case 11 forming the heating space within the main body, there are provided guide portions 24. The guide portions 24 are provided with rails, such that the roller 23 provided in the supporting portion 21 is fitted to the rails and is guided thereby. The rails in the guide portions 24 are provided with inclined surfaces 24*a* which are formed by inclining, downwardly, their end portions closer to the rear surface of the heating space (in the left side in FIG. 1). The roller 23 is moved along the inclined surfaces 24*a*, which causes the supporting portion 21 to be pushed toward the rear surface, thereby bringing the openable door 12 into contact with the peripheral edge portion of the opening of the heating case 11. As a result, the openable door 12 is brought into a closed state where the openable door 12 encloses microwaves within the heating space, and this closed state is certainly maintained.

Further, a protruding portion 26 is formed in the coupling portion 22 provided in the supporting portion 21. When the openable door 12 is in the closed state, the protruding portion 26 is penetrated through an opening formed in the rear-surface wall of the heating space to press a switch 27. When the openable door 12 is closed, the protruding portion 26 pushes the switch 27, which causes the switch 27 to detect that the openable door 12 is being in the closed state and to input a signal indicative of the detection to the control portion 18.

On the other hand, there is provided a stopper 25 for stopping the movement of the roller 23, near the opening of the heating case 11, such that the openable door 12 is stopped at a predetermined position, when the openable door 12 has been pulled out in the horizontal direction from the heating chamber 11 and thus the heating space is in an opened state (see FIG. 1 and FIG. 2).

As illustrated in FIG. 3, the radio-wave transmission suppression portion 19 is formed in the openable door 12, in its heating-space side. The radio-wave transmission suppression portion 19 is formed from two plate members having been worked and shaped. The radio-wave transmission suppression portion 19 is constituted by a base plate 30 made of a metal material, and a suppression plate 31, wherein the base plate 30 has been subjected to two-stages drawing processing at its outer peripheral portion, and the suppression plate 31 is placed such that it is spaced apart by a predetermined interval from the steps at the outer peripheral portion of the base plate 30. In the base plate 30, its outer peripheral portion which has been subjected to the two-stages drawing processing forms a first radio-wave-propagation-direction suppression-area 34A.

On the other hand, the suppression plate 31 is folded such that its outer peripheral portion faces the inner wall surfaces of the opening portion of the heating case 11. The suppression plate 31 has a plurality of cutout portions 35 which are periodically formed in its outer peripheral portion facing the inner wall surfaces of the opening portion of the heating case 11, and these cutout portions 35 form an area as a second radio-wave-propagation-direction suppression-area 34B. In the radio-wave-propagation-direction suppression-area 34B in the suppression plate 31, there are periodically arranged a plurality of suppression protruding portions 31 a having a substantially-T shape, which are formed from the cutout portions 35.

Further, the second radio-wave-propagation-direction suppression-area 34B at the outer peripheral portion of the suppression plate 31 is covered with a protection cover 32 made of a low dielectric-loss dielectric material, in order to prevent intrusions of foreign substances into the radio-wave transmission suppression portion 19.

As illustrated in FIG. 3, the base plate 30 is secured to the door body portion 12*b* in its heating-space side, such that the base plate 30 is attached thereto. The suppression plate 31 in the openable door 12 is provided in such a way as to cover the heating-space side of the base plate 30. The second radio-wave-propagation-direction suppression-area 34B provided with the cutout portions 35, in the outer peripheral portion of the suppression plate 31, is placed such that it faces the first radio-wave-propagation-direction suppression-area 34A, which is the drawing-processed portion at the outer peripheral portion of the base plate 30 with a predetermined interval interposed therebetween.

The screws securing the supporting members in the supporting portion 21 to the openable door 12 are screwed into the door body portion 12*b* in the openable door 12, by being penetrated through assembling holes 33 formed in the heating-space side of the suppression plate 31 and through assembling holes in the base plate 30. Since the supporting members in the supporting portion 21 are secured to the openable door 12 as described above, the base plate 30 and the suppression plate 31 are assembled and secured thereto, concurrently and integrally.

The Structure of the Microwave Generating Portion

As illustrated in FIG. 4, in the drawer type induction heating apparatus according to the first embodiment, the microwave generating portion 13 is structured to include a microwave oscillator 41, amplifiers 42 and 43 in two stages for amplifying the output of the microwave oscillator 41, and an electric-power detection portion 17.

The output of the microwave generating portion 13 is transmitted to the microwave radiation portion 14 through the coaxial transmission line 15 and is radiated within the heating space from the microwave radiation portion 14. As a result, an object to be heated 44 housed within the heating space is heated by microwaves.

In the drawer type heating apparatus according to the first embodiment, the microwave radiation portion 14 is constituted by a so-called patch antenna which utilizes an air layer. The microwave radiation portion 14 is provided on the upper surface wall of the heating case 11 and is placed at a position at the center of the heating space in the leftward and rightward directions and also in front of the center of the heating space in the forward and rearward directions. Further, regarding the position at which the microwave radiation portion 14 is placed with respect to the housing container 20 housed within the heating space, it is a position on the upper surface wall of the heating case 11 which faces the center position in an area specified as an area (a specified area) in which the object to be heated 44 should be placed. Further, the microwave radiation portion 14 is covered with an antenna cover 45 made of a low dielectric-loss material and is protected thereby (see FIG. 1).

Heating Operations in the Drawer Type Heating Apparatus

Next, there will be described heating operations in the drawer type heating apparatus having the structure described according to the first embodiment.

In an opened state where the openable door 12 has been pulled out from the heating case 11, the object to be heated 44 is placed within the specified area in the housing container 20. Then, the openable door 12 is closed. In this closed state, the coupling bar 22 presses the switch 27, thereby closing the contact point in the switch 27. Since the switch 27 is closed, the control portion 18 is supplied with electric power.

On receiving a heating start command and heating conditions for the object to be heated 44, which have been inputted to an operating portion (not illustrated), the control portion 18 operates the driving power supply 16, thereby starting an operation of the microwave generating portion 13.

The electric-power detection portion 17 placed in the output side of the microwave generating portion 13 is adapted to detect supplied microwave electric power supplied to the heating space, and reflected microwave electric power returning to the microwave generating portion 13 from the heating space. The control portion 18 causes the oscillating frequency to sweep a specified output-frequency range of the microwave generating portion 13 (for example, from 2400 MHz to 2500 MHz), at intervals of a predetermined frequency (for example, at intervals of 1 MHz), before actual heating for the object to be heated 44. Further, the control portion 18 extracts, from the electric power detection portion 17, a signal corresponding to the reflected microwave electric power at each oscillating frequency. Further, the control portion 18 extracts an oscillating frequency which minimizes the reflected microwave electric power. The microwave generating portion 13 sets the heating frequency at the extracted oscillating frequency and starts actual heating of the object to be heated 44, with a microwave output corresponding to the heating conditions having been inputted through the operating portion. In the actual heating, the control portion 18 controls the microwave output in such a way as to satisfy predetermined heating conditions and, also, stops the operation of the microwave generating portion 13 for completing the heating operation, when desired conditions (a temperature, a heating time, and the like) have been satisfied.

In the drawer type heating apparatus according to the first embodiment, the heating case 11 forming the heating space has curved-surface shapes at the four corner portions of its opening portion, and the radio-wave transmission suppression portion 19 in the openable door 12 which is faced to these corner portions of the opening portion is also formed to have the same curved surfaces. Therefore, the inner wall surfaces of the opening portion of the heating case 11 are adapted to be faced, over the entire periphery, to the radio-wave transmission suppression portion 19, at the constant distance. As described above, in the drawer type heating apparatus according to the first embodiment, the radio-wave transmission suppression portion 19 faces the inner wall surfaces of the opening portion of the heating case 11 at the constant distance, over its entire periphery, which allows the radio-wave transmission suppression portion 19 to certainly exert its functions, thereby preventing leakages of radio waves from the heating space.

The Radio-Wave Transmission Suppression Portion 19

Next, there will be described the functions and the structure of the radio-wave transmission suppression portion 19 which is provided between the openable door 12 and the heating case 11 forming the heating space within the drawer type heating apparatus according to the first embodiment.

In order to enable the radio-wave transmission suppression portion 19 to exert its function of suppressing radio-wave transmission, it is necessary to create an infinite impedance in the opening 36 between the first radio-wave-propagation-direction suppression-area 34A and the tip end of the second radio-wave-propagation-direction suppression-area 34B, by utilizing the space between the second radio-wave-propagation-direction suppression-area 34B at the outer peripheral portion of the suppression plate 31, and the first radio-wave-propagation-direction suppression-area 34A which is the drawing-processed portion in the base plate 30.

Figure 5:
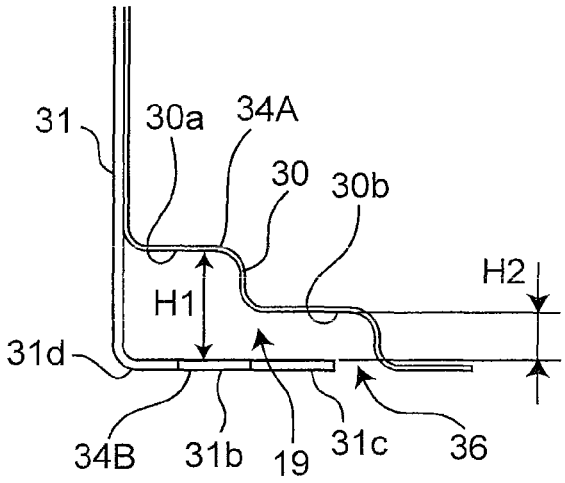
FIG. 5 is a side cross-sectional view illustrating, in detail, the structure of a radio-wave transmission suppression portion in the drawer type heating apparatus according to the first embodiment.
Figure 6:
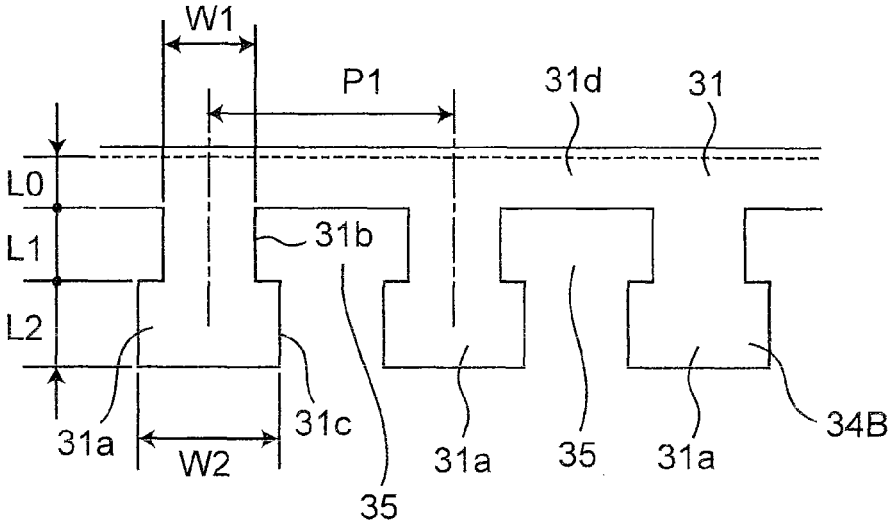
FIG. 6 is a plan view illustrating the shapes of a plurality of suppression protruding portions in a suppression plate in the radio-wave transmission suppression portion in the drawer type heating apparatus according to the first embodiment.

FIG. 5 is a side cross-sectional view illustrating, in detail, the structure of the radio-wave transmission suppression portion 19 in the drawer type heating apparatus according to the first embodiment. FIG. 6 is a plan view illustrating the shapes of the plurality of suppression protruding portions 31*a*, which are formed in the second radio-wave-propagation-direction suppression-area 34B in the suppression plate 31, in the radio-wave transmission suppression portion 19.

As illustrated in FIG. 5, in the base plate 30, its outer peripheral portion has been subjected to two-stage drawing processing to form the first radio-wave-propagation-direction suppression-area 34A. The second radio-wave-propagation-direction suppression-area 34B in the suppression plate 31 is placed such that it faces the first radio-wave-propagation-direction suppression-area 34A in the base plate 30. Between the first radio-wave-propagation-direction suppression-area 34A in the base plate 30 and the second radio-wave-propagation-direction suppression-area 34B in the suppression plate 31, there are formed a first suppression space with a gap dimension of H1, and a second suppression space with a gap dimension of H2. As described above, between the first radio-wave-propagation-direction suppression-area 34A in the base plate 30 and the second radio-wave-propagation-direction suppression-area 34B in the suppression plate 31, there are formed the two suppression spaces with the different gap dimensions.

Further, in the second radio-wave-propagation-direction suppression-area 34B in the suppression plate 31, the plurality of suppression protruding portions 31*a* with the substantially-T shape are periodically arranged with a constant pitch (P1). Each of these suppression protruding portions 31*a* is formed to have a smaller-width portion 31*b* with a width of W1, and a larger-width portion 31*c* with a width of W2 (W2>W1). Further, the smaller-width portion 31*b* has a length of L1, while the larger-width portion 31*c* has a length of L2. Here, these widths of the suppression protruding portions 31*a* are the lengths in the direction along the peripheral edge as the outer periphery of the suppression plate 31. Further, these lengths of the suppression protruding portions 31*a* are the lengths in the direction orthogonal to the direction along the peripheral edge of the suppression plate 31 (see FIG. 6).

The suppression plate 31 having the suppression protruding portions 31*a* having the structure described is placed, such that the surfaces of the smaller-width portions 31*b* are faced to the surface 30*a* of the first step (the step closer to the center) in the two-stage-drawing-processed portion (the first radio-wave-propagation-direction suppression-area 34A) in the base plate 30, thereby forming the first suppression space. In this case, the gap dimension of the first suppression space is H1 (see FIG. 5). Further, the surfaces of the larger-width portions 31*c* in the suppression protruding portions 31*a* are placed, such that they face the surface 30*b* of the second step (the step closer to the outer periphery) in the two-stage-drawing-processed portion (the first radio-wave-propagation-direction suppression-area 34A) in the base plate 30, thereby forming the second suppression space. In this case, the gap dimension of the second suppression space is H2 (H2<H1) (see FIG. 5).

In the structure according to the first embodiment, the suppression plate 31 is folded such that its outer peripheral portion faces the inner wall surfaces of the opening portion of the heating case 11, thereby forming the second radio-wave-propagation-direction suppression-area 34B. In the drawer type heating apparatus according to the first embodiment, the second radio-wave-propagation-direction suppression-area 34B in the suppression plate 31, and the first radio-wave-propagation-direction suppression-area 34A which is the two-stages drawing-processed portion in the base plate 30 form the radio-wave transmission suppression portion 19.

As illustrated in FIG. 6, in the second radio-wave-propagation-direction suppression-area 34B in the suppression plate 31, the suppression protruding portions 31*a* formed periodically are coupled to each other at their root portions through an area 31*d* formed to have a length of L0, thereby ensuring a high mechanical strength of the suppression plate 31. The coupling area 31*d* which couples the root portions of the suppression protruding portions 31*a* to each other is formed from a continuous plate surface with no cutout portion. In the suppression plate 31, the coupling area 31*d* is continuous with the plate surface over the center portion which faces the heating space, through a curved-surface portion which is bent at about 90 degrees, thereby ensuring a high mechanical strength of the suppression plate 31.

In the drawer type heating apparatus according to the first embodiment, the suppression plate 31 and the base plate 30 having the structures described are secured to the door body portion 12*d* in the openable door 12, by assembling the supporting portion 21 through screws. Therefore, the supporting portion 21 has a mechanically strong structure and thus has a structure capable of certainly holding the housing container 20.

Further, in the radio-wave transmission suppression portion 19 having the plurality of suppression spaces formed between the first radio-wave-propagation-direction suppression-area 34A in the base plate 30 and the second radio-wave-propagation-direction suppression-area 34B in the suppression plate 31, the suppression protruding portions 31*a* in the first radio-wave-propagation-direction suppression-area 34A in the suppression plate 31 can be made to have an I-shape. Namely, this corresponds to a case where, in the suppression protruding portions 31*a* having the T shape illustrated in FIG. 6, the width W1 of the smaller-width portions 31*b* and the width W2 of the larger-width portions 31*c* are made to have the same size (a width W). In the case where the suppression protruding portions have such an I shape, it is necessary that the characteristic impedance formed by the first suppression space in the first step portion in the radio-wave transmission suppression portion 19 is set to be at least twice larger than the characteristic impedance formed by the second suppression space in the second step portion. With this structure, it is possible to form the radio-wave transmission suppression portion 19 such that the length (see L0+L1+L2 in FIG. 6) of the space forming it is sufficiently smaller than the quarter-wavelength of transmitted waves. Here, the characteristic impedance formed by the first suppression space in the first step portion in the radio-wave transmission suppression portion 19 is determined, based on the width W of the suppression protruding portions, and based on the dimension 1 between the root portions of the I-shaped suppression protruding portions in the suppression plate 31 (see 31*b* in FIG. 6) and the surface 30*a* of the first step portion in the base plate 30 (see FIG. 5). Further, the characteristic impedance formed by the second suppression space in the second step portion in the radio-wave transmission suppression portion 19 is determined, based on the width W of the suppression protruding portions, and based on the distance dimension 2 between the tip-end portions of the I-shaped suppression protruding portions in the suppression plate 31 (see 31*c* in FIG. 6) and the surface 30*b* of the second step portion in the base plate 30. Accordingly, by structuring the radio-wave transmission suppression portion 19 as described above, even by forming the suppression plate 31 to have an I shape, it is possible to form the radio-wave transmission suppression portion 19 such that it forms a space with a length (see L0+L1+L2 in FIG. 6) sufficiently smaller than the quarter-wavelength of transmitted waves.

As described above, in the drawer type heating apparatus according to the first embodiment, the radio-wave-propagation-direction suppression-area 34B in the suppression plate 31 is formed from the periodic arrangement of the plurality of suppression protruding portions 31*a* which are separated from each other through the cutout portions 35, and also, each of the suppression protruding portions 31*a* is constituted by the smaller-width portion 31*b* (the width W1) and the larger-width portion 31*c* (the width W2> the width W0. As a result, the characteristic impedance determined based on the width W1 of the smaller-width portions 31*b*, and based on the dimension 1 between the smaller-width portions 31*b* which are the root portions of the suppression protruding portions 31*a* and the surface 30*a* of the first step portion in the base plate 30 (see FIG. 5) is (about two or more times) larger than the characteristic impedance determined based on the width W2 of the larger-width portions 31*c*, and based on the dimension 2 between the larger-width portions 31*c* which are the tip-end portions of the suppression protruding portions 31*a* and the surface 30*b* of the second step portion in the base plate 30 (see FIG. 5). Further, the radio-wave transmission suppression portion 19 can be structured such that the space forming it has a length (L0+L1+L2) sufficiently smaller than the quarter-wavelength of transmitted waves. This can make the area in the openable door 12 which internally comes in contact with the inner wall surfaces of the heating case 11 smaller. As a result, in the drawer type heating apparatus according to the first embodiment, it is possible to attain both compactification and weight reduction in the openable door 12.

The structure of the drawer type heating apparatus according to the first embodiment has been described with respect to the case where the number of drawing stages for the base plate 30 for forming the radio-wave transmission suppression portion 19 is two. However, in the present invention, the base plate 30 in the radio-wave transmission suppression portion 19 is not limited to one having two stages, and it is also possible to employ multistage drawing processing with three or more stages for attaining suppression of radio-wave transmission.

Figure 7:
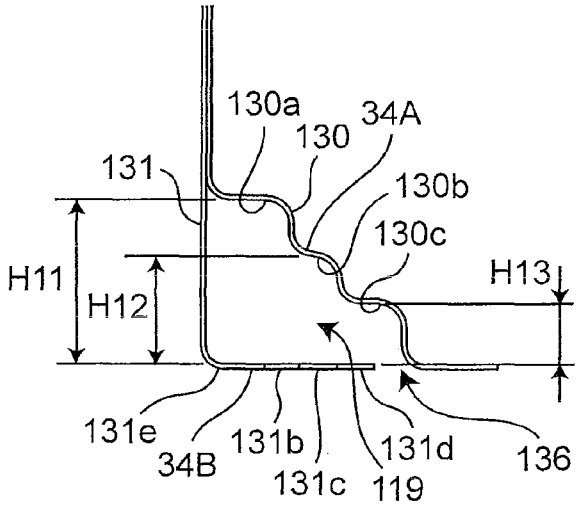
FIG. 7 is a side cross-sectional view illustrating, in detail, the structure of a radio-wave transmission suppression portion having a different structure, in the drawer type heating apparatus according to the first embodiment.
Figure 8:
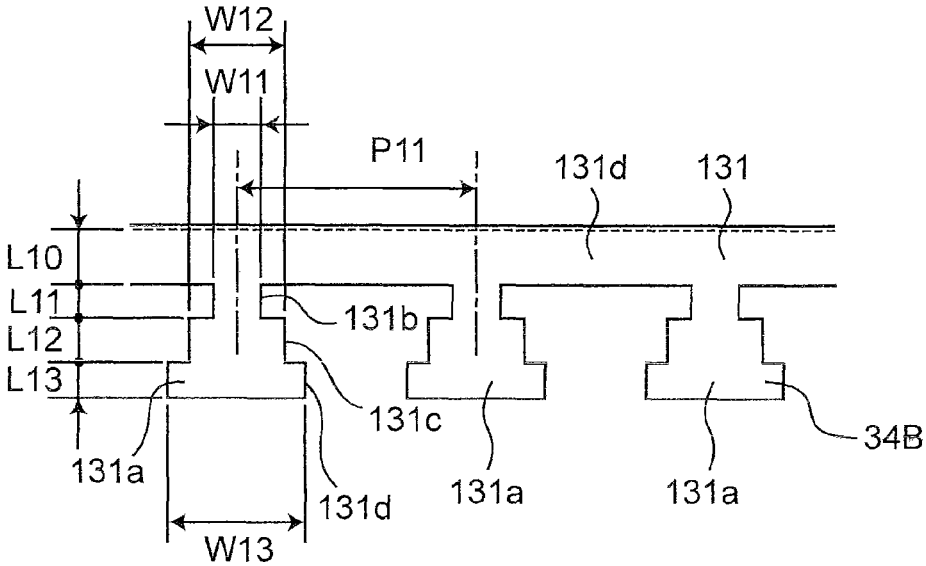
FIG. 8 is a plan view illustrating the shapes of a plurality of suppression protruding portions in a suppression plate in the radio-wave transmission suppression portion illustrated in FIG. 7.

FIG. 7 is a side cross-sectional view illustrating, in detail, the structure of a radio-wave transmission suppression portion 119 having a different structure, in the drawer type heating apparatus according to the first embodiment. FIG. 8 is a plan view illustrating the shapes of a plurality of suppression protruding portions 131*a* in a suppression plate 131 in the radio-wave transmission suppression portion 119 illustrated in FIG. 7.

As illustrated in FIG. 7, the radio-wave transmission suppression portion 119 has a base plate 130 which has been subjected to three-stage drawing processing to form a first radio-wave-propagation-direction suppression-area 34A. The suppression plate 131, which faces the first radio-wave-propagation-direction suppression-area 34A in the base plate 130, is provided with the plurality of suppression protrusions 131*a*, thereby forming a second radio-wave-propagation-direction suppression-area 34B. Namely, between the first radio-wave-propagation-direction suppression-area 34A which is the three-stage-drawing-processed portion in the base plate 130 and the second radio-wave-propagation-direction suppression-area 34B in the suppression plate 131, there are formed a first suppression space with a gap dimension of H11, a second suppression space with a gap dimension of H12, and a third suppression space with a gap dimension of H13. As described above, between the first radio-wave-propagation-direction suppression-area 34A in the base plate 130 and the second radio-wave-propagation-direction suppression-area 34B in the suppression plate 131, there are formed the three suppression spaces with the different gap dimensions. Further, in the second radio-wave-propagation-direction suppression-area 34B in the suppression plate 131, the plurality of suppression protruding portions 131*a* formed stepwise are periodically arranged with a constant pitch (P11). Each of these suppression protruding portions 131*a* is formed to have a smaller-width portion 131*b* with a width of W11, a middle-width portion 131*c* with a width of W12 (W12>W11), and a larger-width portion 131*d* with a width of W13 (W13>W12). Further, the smaller-width portion 131*b* has a length of L11, the middle-width portion 131*c* has a length of L12, and the larger-width portion 131*d* has a length of L13. Here, these widths of the suppression protruding portions 131*a* are the lengths thereof in the direction along the peripheral edge as the outer periphery of the suppression plate 31. Further, these lengths of the suppression protruding portions 131*a* are the lengths thereof in the direction orthogonal to the direction along the peripheral edge of the suppression plate 31 (see FIG. 8).

The suppression plate 131 having the suppression protruding portions 131*a* having the structure described is placed such that the surfaces of the smaller-width portions 131*b* are faced to the surface 130*a* of the first step in the three-stage-drawing-processed portion (the first radio-wave-propagation-direction suppression-area 34A) in the base plate 130, thereby forming the first suppression space. In this case, the gap dimension of the first suppression space is H11 (see FIG. 8). Further, the surfaces of the middle-width portions 131*c* in the suppression protruding portions 131*a* are placed such that they face the surface 130*b* of the second step in the three-stage-drawing-processed portion (the first radio-wave-propagation-direction suppression-area 34A) in the base plate 130, thereby forming the second suppression space. In this case, the gap dimension of the second suppression space is H12 (see FIG. 8). Further, the surfaces of the larger-width portions 131*d* in the suppression protruding portions 131*a* are placed such that they face the surface 130*c* of the third step in the three-stage-drawing-processed portion (the first radio-wave-propagation-direction suppression-area 34A) in the base plate 130, thereby forming the third suppression space. In this case, the gap size of the third suppression space is H13 (H13<H12<H11) (see FIG. 8).

As described above, the radio-wave transmission suppression portion 119 is constituted by the first radio-wave-propagation-direction suppression-area 34A in the base plate 130 and the second radio-wave-propagation-direction suppression-area 34B in the suppression plate 131, which can provide a structure having a higher characteristic-impedance ratio. As described above, it is possible to create an infinite impedance in the opening 136 between the first radio-wave-propagation-direction suppression-area 34A and the tip end of the second radio-wave-propagation-direction suppression-area 34B. Therefore, the radio-wave transmission suppression portion 119 can be structured such that the space forming it has a length (see L10+L11+L12+L13 in FIG. 8) sufficiently smaller than the quarter-wavelength of transmitted waves. This can make the area in the openable door 12 which internally comes in contact with the inner wall surfaces of the heating case 11 smaller, thereby attaining both compactification and weight reduction in the openable door 12.

In the drawer type heating apparatus according to the first embodiment, the microwave radiation portion 14 is constituted by a patch antenna which utilizes an air layer. Due to the use of the patch antenna, it is possible to reduce, as much as possible, the space occupied by the microwave radiation portion 14, within the heating space formed by the heating case 11.

Further, in the drawer type heating apparatus according to the first embodiment, the coaxial transmission line 15 is used for microwave transmission between the microwave generating portion 13 and the microwave radiation portion 14. Due to the use of the coaxial transmission line 15, by utilizing the amount of transmission loss therein, it is possible to suppress the amount of microwave electric power returning to the microwave generating portion 13 to be equal to or less than a specified value, even when the supplied microwave electric power supplied to the heating space is reflected by 100%. For example, in the case where the coaxial transmission line 15 used therein has a transmission loss of 1.5 dB, with respect to the output electric power from the microwave generating portion 13, the reflected microwave electric power returning from the heating space and received by the microwave generating portion 13 is about 50% of the output electric power. As described above, by utilizing the transmission loss effect of the coaxial transmission line 15, it is possible to eliminate a protective component such as an isolator for protecting the microwave generating portion 13 from the reflected electric power, which enables compactification of the structure of the microwave generating portion 13.

Further, in the drawer type heating apparatus according to the first embodiment, the guide portions 24 are provided on the opposite side surfaces of the heating case 11 in order to determine the area in which the supporting portion 21 secured to the openable door 12 can move and, further, the guide portions 24 restrict the displacement of the supporting portion 21 in the upward and downward directions. This restricts the movement of the openable door 12 to which the supporting portion 21 is secured to fall within a predetermined movement range. Further, the openable door 12 can be largely pulled out, in the state where the supporting portion 21 is held on the rails in the guide portions 24.

Further, in the drawer type heating apparatus according to the first embodiment, the microwave radiation portion 14 for radiating microwaves within the heating space is placed at a position faced to the center of the area specifying the position at which the object to be heated 44 should be housed, in the housing container 20 within the heating space. Thus, the object to be heated 44 is placed in the specified area in the housing container 20, and microwaves are directly incident to the object to be heated 44 from above, which can increase the amount of microwave electric power absorbed by the object to be heated 44. This results in reduction of the amount of energy of microwaves propagating over the entire heating space, which can suppress unnecessary heat generation and unnecessary occurrences of sparks, in the housing container 20 housed in the heating space, the supporting portion 21 or the rails in the guide portions 24.

Second Embodiment

Figure 9:
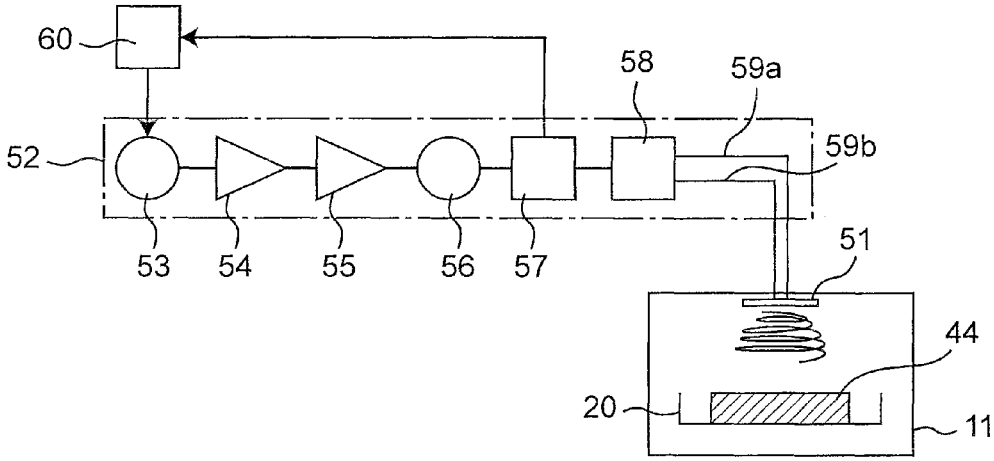
FIG. 9 is a block diagram illustrating the structure of a microwave generating portion in a drawer type heating apparatus according to a second embodiment of the present invention.

Next, there will be described a drawer type microwave heating apparatus as a drawer type heating apparatus according to a second embodiment of the present invention. FIG. 9 is a block diagram illustrating the structure of a microwave generating portion in the drawer type heating apparatus according to the second embodiment. The drawer type heating apparatus according to the second embodiment is a microwave heating apparatus which utilizes circularly polarized wave radiation.

Further, the drawer type heating apparatus according to the second embodiment is different from the structure according to the first embodiment, in terms of the structures of a microwave radiation portion 51 and a microwave generating portion 52. But the other structures, particularly the structures of an openable door and a heating space, are substantially the same as those of the structure according to the first embodiment. Therefore, in the description about the second embodiment, components having the same structures as those of components in the drawer type heating apparatus according to the first embodiment will be designated by the same reference characters and will not be described herein.

In the drawer type heating apparatus according to the second embodiment, the microwave radiation portion 51 placed in the heating space is constituted by a microwave radiation portion 51 formed from an antenna adapted to perform circularly-polarized wave radiation, wherein respective lines connecting the center point to two feeding points are orthogonal to each other, and microwaves supplied to the respective feeding points have a phase difference of 90 degrees.

In the drawer type heating apparatus according to the second embodiment, the microwave generating portion 52 is structured to include a microwave oscillator 53, amplifiers 54 and 55 in two stages for amplifying the output of the microwave oscillator 53, an isolator 56 provided in the output of the amplifier 55 in the last stage, an electric-power detection portion 57 provided in the output of the isolator 56, and an electric-power divider 58 for dividing the output of the electric-power detection portion 57 into two parts and for creating a phase difference of 90 degrees. Further, in the microwave generating portion 52, there are provided transmission paths 59*a* and 59*b* which connect the respective outputs of the electric-power divider 58 to the respective feeding points in the microwave radiation portion 51 for extremely-shorter distances.

Further, in the drawer type heating apparatus according to the second embodiment, there is provided a control portion 60. Signals indicative of supplied microwave electric power supplied to the heating space and reflected microwave electric power reflected toward the isolator 56 from the heating space, which have been detected by the electric-power detector 57, are inputted to the control portion 60. The reflected microwave electric powers from the heating space are transmitted through the respective transmission paths 59*a* and 59*b* and are synthesized in electric power by the electric power divider 58.

The control portion 60 controls the generated frequency and the output electric power from the microwave generating portion 52. The method of control in the drawer type heating apparatus according to the second embodiment is the same as the control method described with respect to the drawer type heating apparatus according to the first embodiment, and therefore will not be described here.

In the drawer type heating apparatus according to the second embodiment, the microwave radiation portion 51 for radiating circularly-polarized waves is adapted to utilize an air layer similarly to in the first embodiment, and is formed from a circular plate. There are provided the two feeding portions at points spaced apart from the center of the circular plate by predetermined distances, and the straight lines connecting the respective feeding points to the center of the circular plate are orthogonal to each other.

As described above, in the drawer type heating apparatus according to the second embodiment, the microwave radiation portion 51 has an antenna structure for radiating circularly-polarized waves, so that the space occupied by the antenna within the heating space can be a substantially equal space to that of the patch antenna structure in the drawer type heating apparatus according to the first embodiment, which enables increase in the space for housing an object to be heated 44 within the heating space.

Further, in the drawer type heating apparatus according to the second embodiment, the microwave radiation portion 51 for radiating microwaves within the heating space is placed at a position faced to the center of the area specifying the position at which the object to be heated 44 should be housed, in the housing container 20 within the heating space. Thus, the object to be heated 44 is placed in the specified area in the housing container 20, and microwaves are directly incident to the object to be heated 44 from above, which can increase the amount of microwave electric power absorbed by the object to be heated 44. This results in reduction of the amount of energy of microwaves propagating over the entire heating space, which can suppress unnecessary heat generation and unnecessary occurrences of sparks, in the housing container 20 housed in the heating space, the supporting portion 21 or the rails in the guide portions 24.

Further, in order to ensure that microwaves supplied to the feeding points in the microwave radiation portion 51 have a phase difference of 90 degrees, it is preferable to employ extremely-short wiring between the electric-power divider 58 and the respective transmission paths 59*a* and 59*b*. For example, it is desirable to structure the microwave generating portion 52 such that it is mounted on the wall surface of the heating case 11 on which the microwave radiation portion 51 is placed. Accordingly, the drawer type heating apparatus according to the second embodiment does not employ a coaxial transmission line, as in the structure according to the first embodiment, and therefore, the microwave generating portion 52 is provided with the isolator 56 for inducing heat losses in the reflected microwave electric power having been reflected from the heating space and returning to the electric-power divider and for absorbing such heat losses.

Further, the structures of the drawer type heating apparatuses according to the first and second embodiments have been described with respect to examples where there is provided, on the rear-surface wall of the heating space, a switch for detecting states where objects to be heated have been housed in the heating space and the openable door 12 has been closed, but the present invention is not limited to this structure. For example, a switch for detecting states where the openable door 12 has been closed can be provided on the front-surface side wall surface in the heating space.

Further, the structures of the drawer type heating apparatuses according to the first and second embodiments have been described with respect to structures where the microwave radiation portion as an antenna is placed on the upper surface wall of the heating space, but the present invention is not limited to this structure. The microwave radiation portion can be provided on any of the wall surfaces. Also, a plurality of microwave radiation portions can be placed thereon.

As described above, the drawer type heating apparatus according to the present invention is structured such that the radio-wave transmission suppression portion provided in the drawer type openable door is placed in such a way as to face the inner wall surfaces of the opening portion of the heating space in which the object to be heated is housed, with a constant interval interposed therebetween. This allows the radio-wave transmission suppression portion to certainly exert its function, over its entire periphery. Accordingly, with the present invention, it is possible to structure the openable door such that its area which faces the opening area of the heating space is compactified, and also its length in the depthwise direction (the thickness) is smaller. The drawer type heating apparatus having the structure described according to the present invention is capable of realizing a heating space with a larger opening area with respect to the shape of the openable door, and the drawer type heating apparatus can be mounted in drawer portions in system kitchens in cooking rooms or mounted to other apparatuses such as refrigerators or vending machines through integral assembling.

INDUSTRIAL APPLICABILITY

With the drawer type heating apparatus according to the present invention, it is possible to realize a microwave heating apparatus with excellent safety and a reduced size and with a drawer type structure. Therefore, the drawer type heating apparatus can be mounted in drawer portions in system kitchens in cooking rooms or mounted to other apparatuses such as refrigerators or vending machines through integral assembling. Thus, the drawer type heating apparatus according to the present invention forms a heating apparatus with excellent general versatility.

The invention claimed is:

1. A drawer type heating apparatus comprising:

a microwave radiation portion adapted to radiate microwaves within a heating space in which an object to be heated is placed; and a heating chamber structural member adapted to enclose microwaves radiated within the heating space; wherein the heating chamber structural member includes a heating case having an opening portion formed from a curved surface, and an openable door which is adapted to be moved in a pull-out manner with respect to the heating case for opening and closing the opening portion in the heating case and includes a radio-wave transmission suppression portion faced to an inner wall surface of the opening portion in the heating case, the radio-wave transmission suppression portion is placed such that there is a predetermined gap between the radio-wave transmission suppression portion and an entire periphery of the inner wall surface of the opening portion in the heating case, in a state where the openable door is closed, and the radio-wave transmission suppression portion includes a first radio-wave-propagation-direction suppression-area comprising a stepped surface with a plurality of steps, and a second radio-wave-propagation-direction suppression-area comprising suppression protruding portions which are periodically formed and placed in such a way as to face the first radio-wave-propagation-direction suppression-area with a predetermined interval interposed, and wherein:

each of the suppression protruding portions, which is faced to the inner wall surface of the opening portion in the heating case, is configured to have a flat surface having a smaller-width portion which is a root portion of the suppression protruding portion and a larger-width portion which is a tip-end portion of the suppression protruding portion so that the flat surface faced to the stepped surface of the first radio-wave-propagation-direction suppression-area increases in width from the smaller-width portion to the larger-width portion in stepwise, and the radio-wave transmission suppression portion has suppression spaces which have different gap dimensions of the faced surfaces between the flat surface of the suppression protruding portion, which is faced to the first radio-wave-propagation-direction suppression-area, and each of the stepped surfaces of the first radio-wave-propagation-direction suppression-area.

2. The drawer type heating apparatus according to claim 1, wherein the openable door includes a base plate having the first radio-wave-propagation-direction suppression-area having the plurality of steps formed through drawing processing, and a suppression plate having the second radio-wave-propagation-direction suppression-area in which the suppression protruding portions are periodically formed.

3. The drawer type heating apparatus according to claim 2, wherein the openable door includes a supporting portion secured to a heating-space side of the openable door through the base plate and the suppression plate, and the supporting portion is adapted to hold a housing container on which the object to be heated is placed, and the heating case includes a guide portion which is secured to an inner wall surface of the heating case and is adapted to engage with a portion of the supporting portion to define an area within which the supporting portion is movable.

4. The drawer type heating apparatus according to claim 3, further comprising a microwave generating portion for supplying microwaves to an inside of the heating space, wherein the microwave radiation portion, which radiates microwaves from the microwave generating portion to the heating space, is provided at a position on a wall surface of the heating case which is faced to a center of an area which specifies a housing position in the housing container within the heating space.

5. The drawer type heating apparatus according to claim 4, wherein the microwave generating portion includes an electric-power detection portion adapted to detect at least reflected microwave electric power, out of supplied microwave electric power supplied to the heating space, and reflected microwave electric power reflected from the heating space, and there is provided a control portion which is adapted to control an oscillating frequency of the microwave generating portion, based on a signal indicative of the reflected microwave electric power.

6. The drawer type heating apparatus according to claim 4, further comprising a coaxial transmission line, as a transmission line for transmitting an output from the microwave generating portion to the microwave radiation portion.

7. The drawer type heating apparatus according to claim 4, wherein the microwave radiation portion comprises a patch antenna.

8. The drawer type heating apparatus according to claim 4, wherein the microwave radiation portion comprises an antenna adapted to perform circularly-polarized wave radiation.

* * * * *